US008210203B2

(12) United States Patent
DeVries et al.

(10) Patent No.: US 8,210,203 B2
(45) Date of Patent: Jul. 3, 2012

(54) ASPIRATOR FOR A SHOWER FITTING

(75) Inventors: Adam M. DeVries, Anderson, IN (US); Kyle Robert Davidson, Noblesville, IN (US)

(73) Assignee: Masco Corporation of Indiana, Indianapolis, IN (US)

( * ) Notice: Subject to any disclaimer, the term of this patent is extended or adjusted under 35 U.S.C. 154(b) by 663 days.

(21) Appl. No.: 12/393,813

(22) Filed: Feb. 26, 2009

(65) Prior Publication Data

US 2010/0212759 A1 Aug. 26, 2010

(51) Int. Cl.

| | |
|---|---|
| ***F16K 11/20*** | (2006.01) |
| ***A23G 9/28*** | (2006.01) |
| ***E03B 1/00*** | (2006.01) |
| ***A01G 25/16*** | (2006.01) |

(52) U.S. Cl. ..... 137/597; 137/602; 137/605; 137/606; 137/625; 137/625.47; 137/876

(58) Field of Classification Search ..... 4/675–678; 137/119.05, 888, 597, 602, 605, 606, 625, 137/625.47, 876

See application file for complete search history.

(56) References Cited

U.S. PATENT DOCUMENTS

| | | | | |
|---|---|---|---|---|
| 2,507,467 | A | 5/1950 | Fredrickson et al. | |
| 2,655,992 | A | 10/1953 | LeRenard | |
| 3,012,251 | A | 12/1961 | Fife | |
| 3,471,872 | A | 10/1969 | Symmons | |
| 3,943,970 | A * | 3/1976 | Knapp | 137/597 |
| 4,095,610 | A | 6/1978 | Priesmeyer | |
| 4,301,972 | A | 11/1981 | Rudelick | |
| 4,393,523 | A | 7/1983 | Nolden | |
| 4,628,962 | A * | 12/1986 | Pezzarossi | 137/597 |
| 4,899,397 | A | 2/1990 | Crawford et al. | |
| 4,901,750 | A | 2/1990 | Nicklas et al. | |
| 4,997,007 | A | 3/1991 | Niemann et al. | |
| 5,137,048 | A | 8/1992 | Brattoli | |
| 5,355,906 | A | 10/1994 | Marty et al. | |
| 5,573,186 | A | 11/1996 | Loschelder | |
| 5,622,203 | A | 4/1997 | Givler et al. | |
| 5,944,358 | A | 8/1999 | Ching et al. | |
| 2006/0231140 | A1 | 10/2006 | McNerney | |
| 2007/0056639 | A1 | 3/2007 | McNerney | |

FOREIGN PATENT DOCUMENTS

EP 1 031 665 A2 8/2000

* cited by examiner

*Primary Examiner* — Len Tran
*Assistant Examiner* — Ryan Reis
(74) *Attorney, Agent, or Firm* — Faegre Baker Daniels LLP

(57) ABSTRACT

An aspirator configured to be received within a shower fitting for generating a negative pressure in response to water flow.

16 Claims, 5 Drawing Sheets

ASPIRATOR FOR A SHOWER FITTING

BACKGROUND AND SUMMARY OF THE INVENTION

Conventional shower installations are known to include both a tub spout and a shower head. The tub spout and the shower head are often connected to the same valve assembly. Such shower installations often further include a diverter valve coupled to the tub spout, so that in a first position the diverter valve allows water to exit through the tub spout and in a second position the diverter valve closes off the outlet through the tub spout, thereby forcing water up through a shower riser to the shower head.

A common problem with such a diverter valve arrangement between the tub spout and the shower head is that there is no positive shut off to the shower head. Even when the diverter valve is positioned to direct water through the tub spout, sufficient pressure may build up within the shower riser so that water leaks through the shower head.

Previous attempts to prevent leakage through the shower head have provided an aspirator insert, sometimes called an ejector, which uses the well-known venturi effect to create a vacuum in the shower head when water is flowing out of the tub spout. It is desirable to provide an aspirator that does not significantly limit the available flow of water therethrough, while also prevents undesired vibration and subsequent noise.

According to an illustrative embodiment of the present disclosure, a shower fitting includes a housing having an inlet, a first outlet, a second outlet, and an inner surface defining a bore in fluid communication with the inlet, the first outlet and the second outlet. An aspirator includes a body received within the bore. The body includes a first end, a second end, and a sidewall defining an inner passageway extending along a longitudinal axis between the first end and the second end. The sidewall includes a plurality of longitudinally extending flutes having a plurality of recesses. An outer passageway extends between the plurality of recesses of the aspirator and the inner surface of the bore. The outer passageway includes a first end sealed from the first outlet, and a second end in open communication with the second outlet such that a negative pressure is exerted on the inner passageway by fluid flow through the outer passageway to the second outlet.

According to a further illustrative embodiment of the present disclosure, a shower fitting includes a housing configured to receive a flow control valve and including an inner surface defining a bore. An aspirator includes a body received within the bore. The body includes a first end, a second end, and a sidewall defining an inner passageway extending along a longitudinal axis between the first end and the second end. The sidewall includes a plurality of longitudinally extending flutes having a plurality of recesses, and a plurality of lands separating the plurality of recesses. At least a portion of each flute is configured to provide an interference fit with the inner surface of the bore. An outer passageway extends between the plurality of recesses of the aspirator and the inner surface of the bore.

According to another illustrative embodiment of the present disclosure, an aspirator is configured to be positioned in a shower fitting having a vertical bore with a lower outlet and an upper outlet. The aspirator includes a lower end, an upper end spaced above the lower end and sealingly engaging an inner surface of the vertical bore between the lower outlet and the upper outlet. A sidewall defines an inner passageway extending between the lower end and the upper end. A plurality of longitudinally extending flutes are supported by the sidewall. The flutes include a plurality of recesses, and a plurality of lands separating the plurality of recesses, wherein the recesses are in open communication with the lower outlet.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

Figure 1:
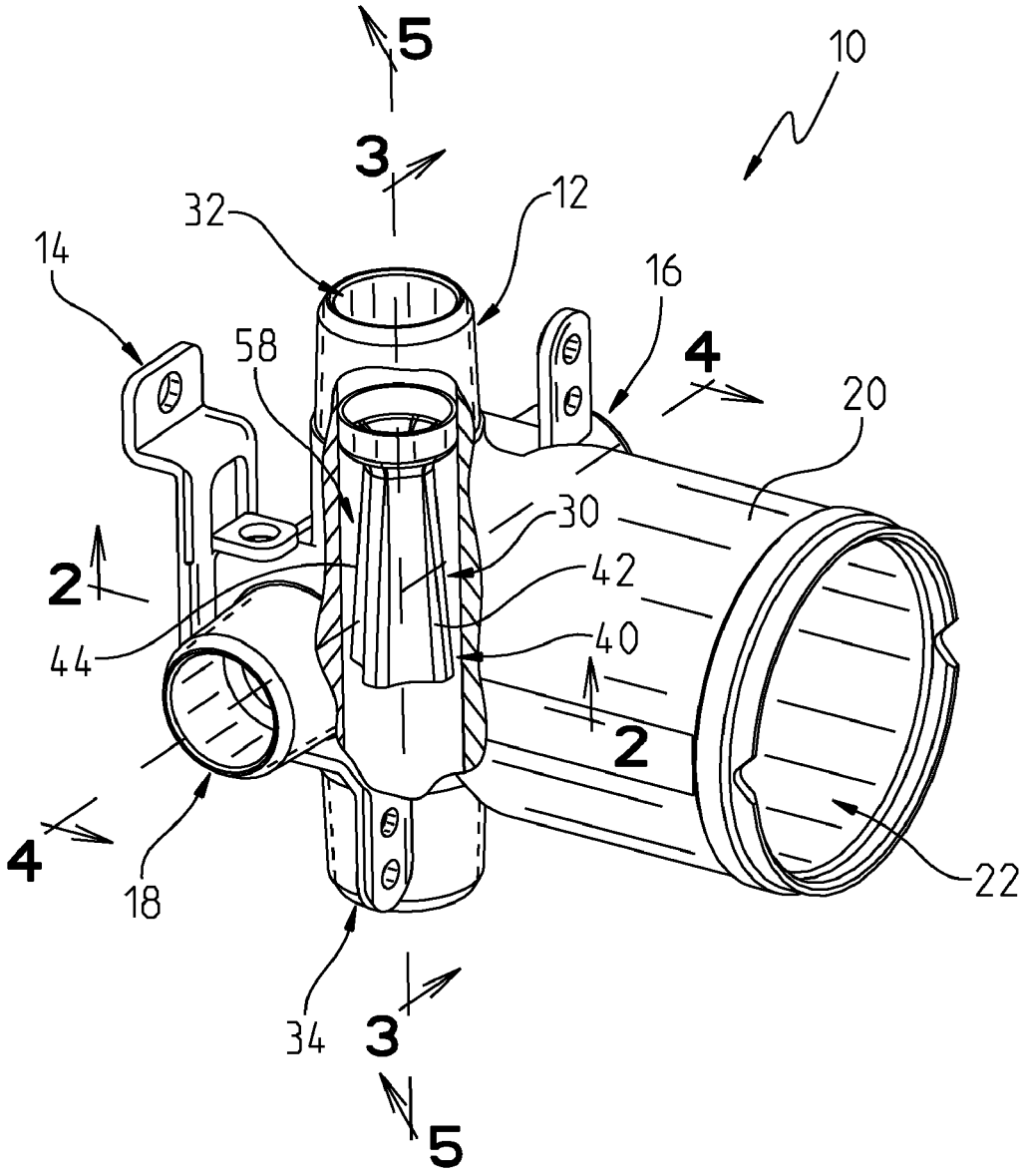
FIG. 1 is a perspective view, with a partial cut-away thereof, of a shower fitting according to an illustrative embodiment of the present disclosure.

The embodiments of the invention described herein are not intended to be exhaustive or to limit the invention to precise forms disclosed. Rather, the embodiment selected for description have been chosen to enable one skilled in the art to practice the invention.

Referring initially to FIGS. 1-5, a shower fitting 10 is illustrated as including a valve body or housing 12 coupled to a mounting bracket 14. The valve housing 12 includes a tubular cold water inlet 16, which is configured to be fluidly coupled to a conventional cold water supply 17 (FIG. 6), and a tubular hot water inlet 18, which is configured to be fluidly coupled to a conventional hot water supply 19 (FIG. 6). The valve housing 12 further illustratively includes a cylindrical wall 20 defining a mixing chamber 22, which upon final assembly is configured to receive a conventional valve member or cartridge (not shown), thereby defining a valve assembly 23 (FIG. 6). Conventional valve cartridges are known, such as that disclosed in U.S. Pat. No. 4,901,750 to Nicklas et al. and U.S. Pat. No. 5,355,906 to Marty et al., the disclosures of which are expressly incorporated by reference herein.

Figure 3:
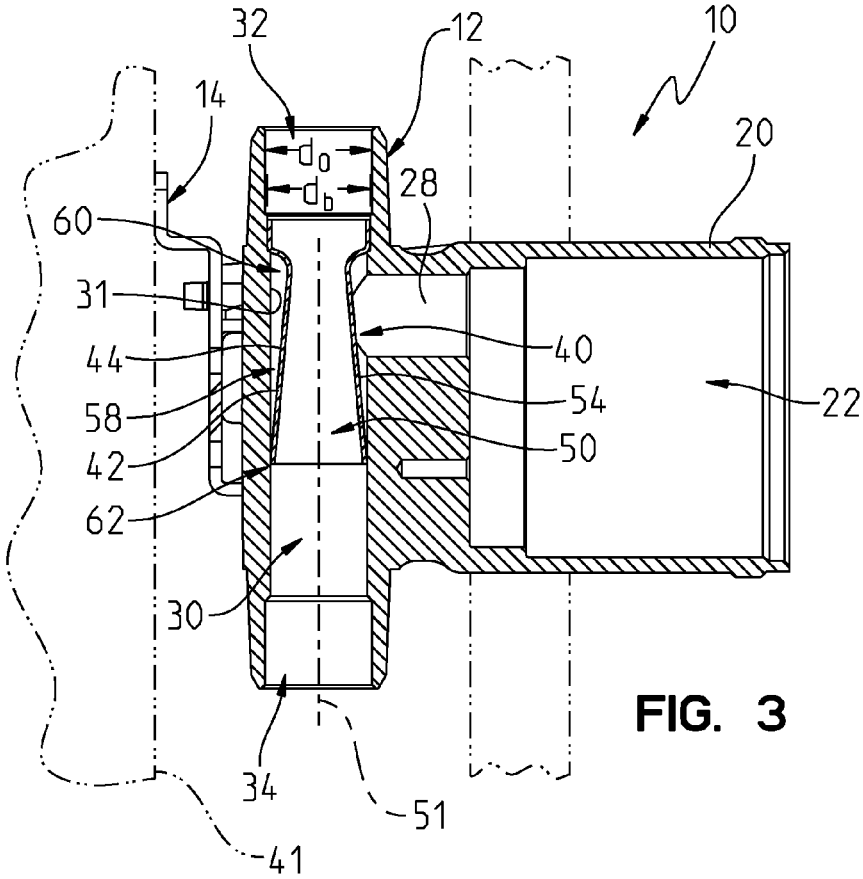
FIG. 3 is a cross-sectional view taken along line 3-3 of FIG. 1.
Figure 4:
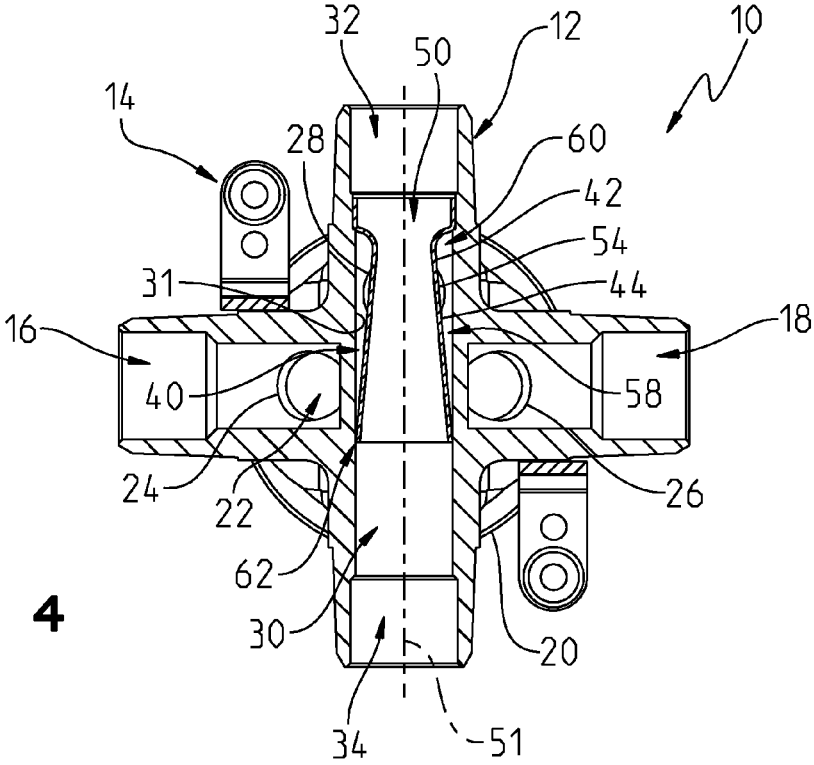
FIG. 4 is a cross-sectional view taken along line 4-4 of FIG. 1.

With reference to FIG. 4, a cold water connecting port 24 provides fluid communication between the cold water inlet 16 and the mixing chamber 22. Likewise, a hot water connecting port 26 provides fluid communication between the hot water inlet 18 and the mixing chamber 22. As shown in FIGS. 3 and 4, a mixed water connecting port 28 provides fluid communication between the mixing chamber 22 and an outlet bore 30. Illustratively, the outlet bore 30 is defined by a cylindrical inner surface 31 and is disposed perpendicular to the inlets 16 and 18. More particularly, the inlets 16 and 18 are illustratively disposed substantially horizontal, while the outlet bore 30 is disposed substantially vertical. The outlet bore 30 provides fluid communication between a first or upper outlet 32 and a second or lower outlet 34. Illustratively, as shown in FIG. 6, the first outlet 32 is configured to be fluidly coupled to a conventional shower head 35 through a shower riser 36. The second outlet 34 is configured to be fluidly coupled to a conventional tub spout 37, illustratively including a diverter valve 38, through a delivery pipe 39. Such an arrangement is shown in U.S. Pat. No. 4,899,397 to Crawford et al., the disclosure of which is expressly incorporated by reference herein.

As shown in FIG. 3, the mounting bracket 14 is configured to be secured to a wall support, typically a stringer 41, which is a horizontally mounted piece of wood positioned between two studs (not shown). The mounting bracket may be of the type disclosed in U.S. patent application Ser. No. 11/107,616, filed Apr. 14, 2005, the disclosure of which is expressly incorporated by reference herein.

Figure 7:
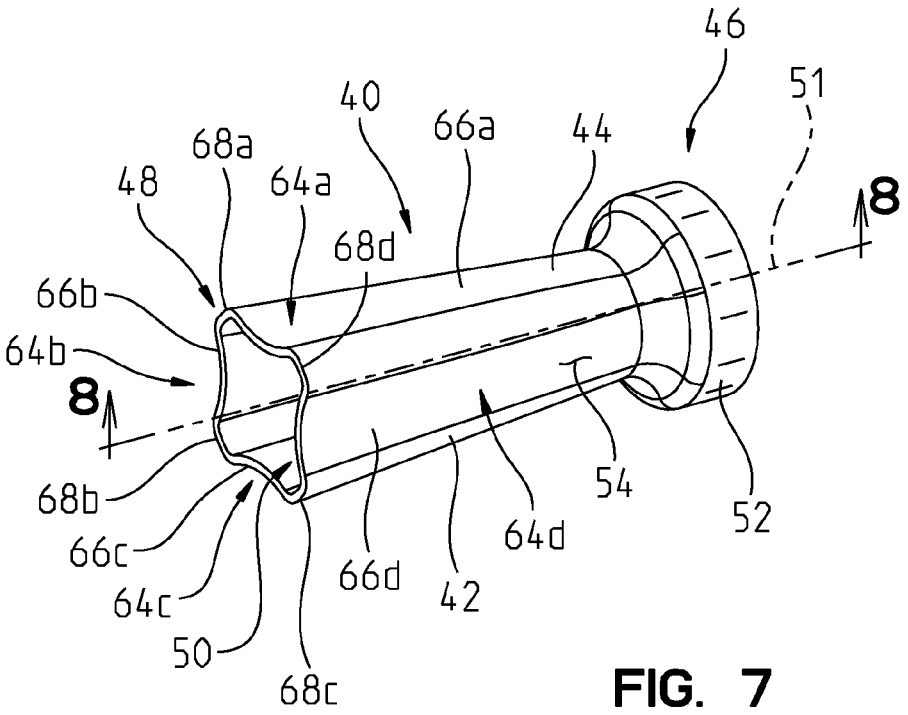
FIG. 7 is a perspective view of an aspirator according to the illustrative embodiment of the present disclosure.
Figure 8:
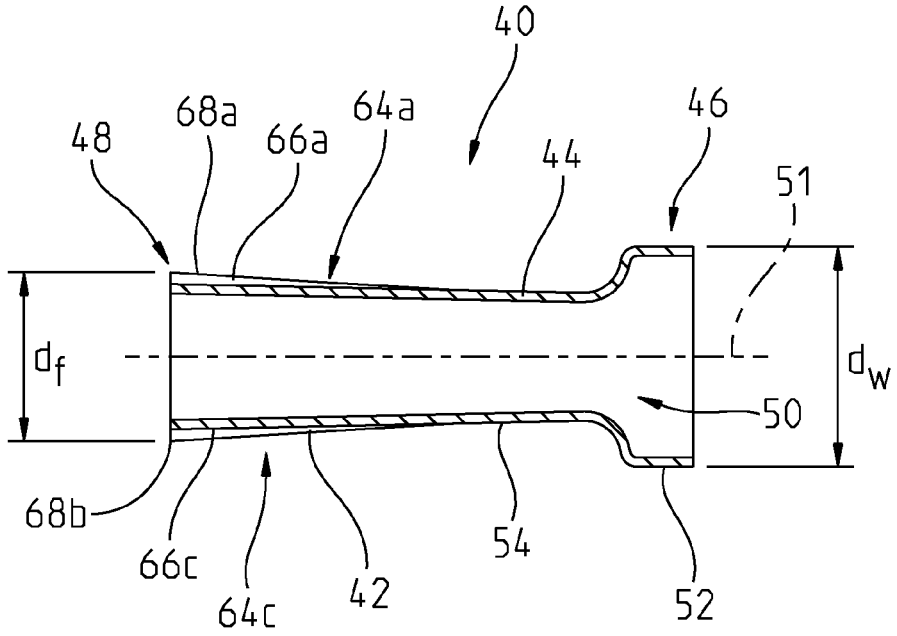
FIG. 8 is a cross-sectional view taken along line 8-8 of FIG. 7.

As shown in FIGS. 1-5, an aspirator or ejector 40 is positioned within the bore 30 intermediate the first outlet 32 and the second outlet 34. With reference to FIGS. 7 and 8, the aspirator 40 includes an aspirator body 42 including a sidewall 44 extending between a first or upper end 46 and a second or lower end 48. An inner passageway 50 extends axially along a longitudinal axis 51 between the first end 46 and the second end 48. An end wall or flange 52 extends radially outwardly from the first end 46 of the body 42 and is configured to be sealingly received within the bore 30. More particularly, the end wall 52 is illustratively press fit within the bore 30 to define an interference fit with the inner surface 31 and, as such, secures the aspirator 40 within the valve housing 12. Moreover, the end wall 52 illustratively has an outer diameter $d_w$ (FIG. 8) greater than an inner diameter $d_b$ of the bore 30, thereby providing the interference fit around the circumference of the end wall 52. In one illustrative embodiment, outer diameter $d_w$ is approximately 0.611 inches, while inner diameter $d_b$ is approximately 0.585 inches, thereby providing an approximately 0.013 radial interference between the end wall 52 and the inner surface 31 of the bore 30. Further, the outlets 32 and 34 illustratively have inner diameters $d_o$ greater than outer diameter $d_w$ of the end wall 52, thereby providing clearance therebetween to assist during assembly.

Figure 5:
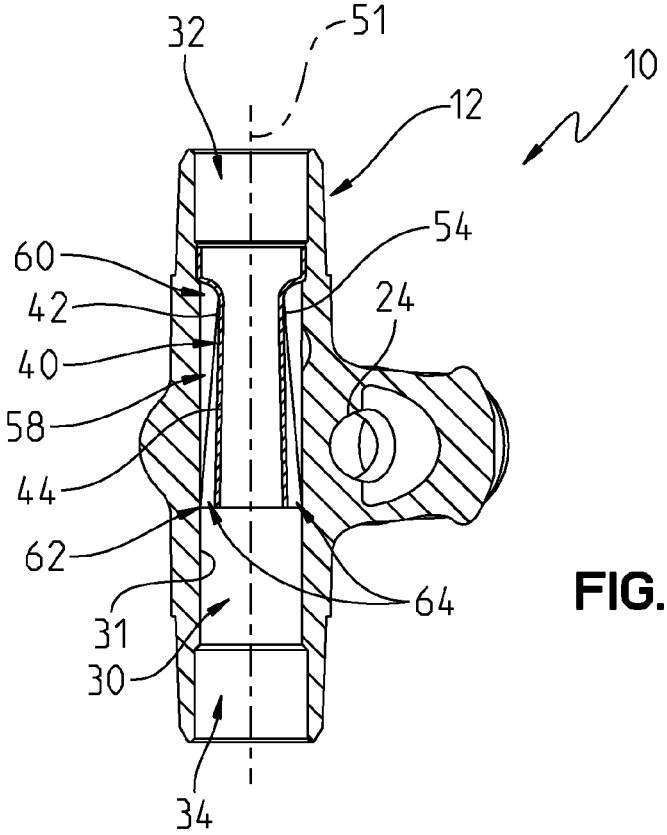
FIG. 5 is a cross-sectional view taken along line 5-5 of FIG. 1.
Figure 6:
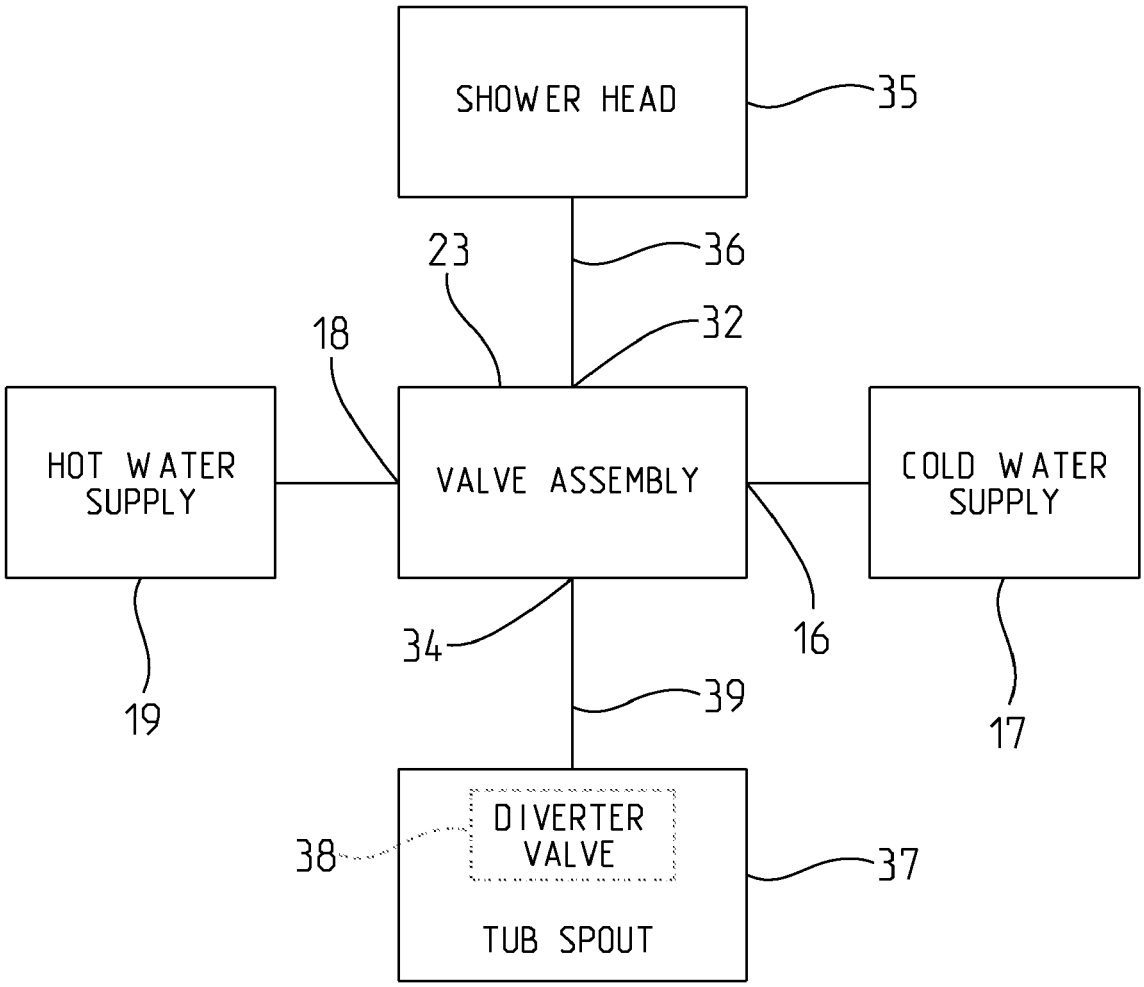
FIG. 6 is a diagrammatic view of a shower installation including the illustrative shower fitting of FIG. 1.

With further reference to FIGS. 3-5, at least a portion of the outer surface 54 of the body 42 is positioned in spaced relation to the inner surface 31 of the bore 30. An outer passageway 58 is defined intermediate the outer surface 54 of the body 42 and the inner surface 31 of the bore 30, wherein the outer passageway 58 has a sealed first or upper end 60 and an open second or lower end 62. The outer passageway 58 opens to the full-width bore 30 proximate the open second end 62 thereby providing open communication with the second outlet 34.

Figure 2:
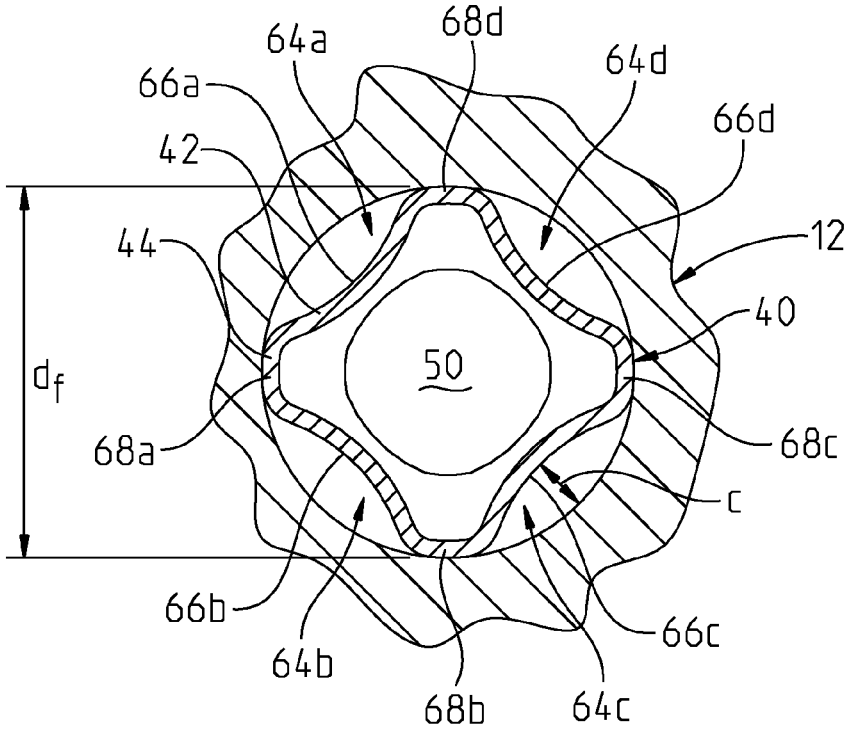
FIG. 2 is a cross-sectional view taken along line 2-2 of FIG. 1.

With reference to FIGS. 2, 7, and 8, the sidewall 44 of the aspirator body 42 includes a plurality of longitudinally extending flutes 64. The flutes 64*a*, 64*b*, 64*c*, 64*d* include a plurality of arcuate recesses 66*a*, 66*b*, 66*c*, 66*d* separated by a plurality of arcuate lands 68*a*, 68*b*, 68*c*, 68*d*. As shown, the outer passageway 58 extends between the plurality of recesses 66*a*, 66*b*, 66*c*, 66*d* and the inner surface 31 of the bore 30. In other words, the recesses 66*a*, 66*b*, 66*c*, 66*d* define at least a portion of the outer passageway 58 through which fluid flows from proximate the upper end 60 to the lower end 62. Illustratively, the recesses 66*a*, 66*b*, 66*c*, 66*d* include a clearance c sufficient for the passage of debris therethrough (FIG. 2). In one illustrative embodiment, the clearance c is defined to be at least 0.080 inches.

In the illustrative embodiment, four recesses 66*a*, 66*b*, 66*c*, 66*d* are separated by four lands 68*a*, 68*b*, 68*c*, 68*d*. Each recess 66*a*, 66*b*, 66*c*, 66*d* and land 68*a*, 68*b*, 68*c*, 68*d* are oriented 90 degrees from adjacent recesses 66*a*, 66*b*, 66*c*, 66*d* and lands 68*a*, 68*b*, 68*c*, 68*d*. However, it should be appreciated that the number and orientation of the recesses 66*a*, 66*b*, 66*c*, 66*d* and lands 68*a*, 68*b*, 68*c*, 68*d* of the flutes 64*a*, 64*b*, 64*c*, 64*d* may vary. In the illustrative embodiment, diametrically opposed lands 68*a*, 68*c* and 68*b*, 68*d* of flutes 64 are configured to provide an interference fit with the inner surface 31 of the bore 30. In one illustrative embodiment, the diametrically opposed lands 68*a*, 68*c* and 68*b*, 68*d* define an outer dimension $d_f$, while the bore 30 illustratively has inner diameter $d_b$. Illustratively, $d_f$ is equal to approximately 0.595 inches, while $d_b$ is equal to approximately 0.585 inches, thereby providing an approximate 0.005 radial interference between flutes 64 and bore 30. Support of opposing ends 46 and 48 of aspirator body 42 is provided to reduce vibration and resulting noise of aspirator 40 during operation.

The sidewall 44 of the aspirator 40 generally tapers outwardly as it extends from proximate the first end 46 toward the second end 48. In other words, the flutes 64 taper inwardly toward the longitudinal axis 51 as the flutes 64 extend from the second end 48 toward the first end 46. As such, the outer surface 54 of the sidewall 44 gradually expands radially outwardly as the surface 54 extends in a direction from proximate the first end 46 to the second end 48. As such, the cross-sectional flow area of outer passageway 58 reduces in size from proximate the first end 60 to the second end 62. In one illustrative embodiment, the cross-sectional flow area decreases from about 0.15 $in^2$ proximate the first end 60 to about 0.08 $in^2$ proximate the second end 62. Of course, the relative cross-sectional flow areas may vary depending upon the desired flow rate capacity. The reduction in cross-sectional flow area of the outer passageway 58 causes the velocity of water to increase as it flows from proximate the first end 60 to the second end 62. As the velocity of the water increases from proximate the first end 60 to the second end 62, the pressure of the water decreases. Proximate the second end 48 of the body 42 (e.g., the open second end 62 of the outer passageway 58), a localized but significant decrease in pressure occurs due to the well-known venturi effect in combination with an abrupt expansion in flow area within the bore 30. This negative pressure is applied to the shower riser 36, effectively allowing air to be sucked through the shower head 35 as water flows through the spout 37.

Illustratively, the valve housing 12 and the body 42 of aspirator 40 are formed of a durable metal, such as brass. However, it should be appreciated that the valve housing 12 and the aspirator 40 may be formed of other suitable materials.

In operation, cold water enters through the cold water inlet 16, while hot water enters through the hot water inlet 18. The cold water is supplied to the mixing chamber 22 through the cold water connecting port 24, while the hot water is supplied to the mixing chamber 22 through the hot water connecting port 26. The cold water and the hot water are combined, as appropriate, in the mixing chamber 22 and then supplied to the mixed water connecting port 28 through operation of the valve cartridge of the valve assembly 23.

The mixed water passes through the connecting port 28 to the outer passageway 58 defined between the body 42 and the bore 30. The water travels axially from proximate the sealed first end 60 to the open second end 62. The sidewall 44 of the aspirator 40 and the inner surface 31 of the bore 30 cooperate to cause a reduction of cross-sectional flow area of the outer passageway 58, resulting in increased velocity and reduced pressure of the water. The gradual reduction in cross-sectional area and the overall length of the outer passageway 58 from the first end 60 to the second end 62 assists in removing turbulence from the water flow, providing more laminar characteristics. As the water flows past the second end 48 of the body 42, a venturi effect causes a localized drop in pressure resulting in a negative pressure or vacuum pulling air through the inner passageway 50 as water flows through the second outlet 34 and the tub spout 37. The vacuum is likewise pulled through the first outlet 32, the shower riser 36, and the shower head 35 to prevent undesirable water leakage therefrom.

When water is desired at the shower head 35, the diverter valve 38 is placed in a closed position and water then backs up through the inner passageway 50. Water continues to flow through the first outlet 32, up through the shower riser 36, and then passes through the shower head 35.

Although the invention has been described in detail with reference to certain preferred embodiments, variations and modifications exist within the spirit and scope of the invention as described and defined in the following claims.

The invention claimed is:

1. A shower fitting comprising:

a housing including an inlet, a first outlet, a second outlet, and an inner surface defining a bore in fluid communication with the inlet, the first outlet and the second outlet;

an aspirator including a body received within the bore, the body including a first end, a second end, and a sidewall defining an inner passageway extending along a longitudinal axis between the first end and the second end, the sidewall including a plurality of longitudinally extending flutes having a plurality of concave recesses extending between the sidewall of the aspirator and the inner surface of the bore, the flutes extending from proximate the first end of the body in fluid communication with the inlet of the housing to proximate the second end of the body in fluid communication with the second outlet of the housing; and an outer passageway extending between the plurality of recesses of the aspirator and the inner surface of the bore, the outer passageway including a first end sealed from the first outlet, and a second end in open communication with the second outlet such that a negative pressure is exerted on the inner passageway by fluid flow through the outer passageway to the second outlet.

2. The shower fitting of claim 1, wherein the outer passageway includes a first cross-sectional flow area proximate the first end and a second cross-sectional flow area proximate the second end, the first cross-sectional flow area being greater than the second cross-sectional flow area.

3. The shower fitting of claim 2, wherein the flutes taper inwardly toward the longitudinal axis as the flutes extend from the second end toward the first end.

4. The shower fitting of claim 1, further comprising a connecting port in fluid communication with the inlet and the bore, the connecting port extending radially relative to the bore and positioned adjacent the first end.

5. The shower fitting of claim 1, wherein a plurality of lands separate the plurality of recesses of the flutes, at least a portion of each flute configured to provide an interference fit with the inner surface of the bore.

6. The shower fitting of claim 5, wherein the first end of the body includes an end wall sealingly engaging the inner surface of the bore for sealing the outer passageway from the first outlet.

7. The shower fitting of claim 1, wherein the recesses of the flutes provide at least 0.080 inch clearance with the inner surface of the bore to permit passage of debris.

8. A shower fitting comprising:

a housing configured to receive a flow control valve, the housing including an inner surface defining a bore;

an inlet, a first outlet, and a second outlet fluidly coupled to the first outlet by the bore;

an aspirator including a body received within the bore, the body including a first end, a second end, and a sidewall defining an inner passageway extending along a longitudinal axis between the first end and the second end, the sidewall including a plurality of longitudinally extending flutes having a plurality of recesses, and a plurality of lands separating the plurality of recesses, wherein the flutes taper inwardly toward the longitudinal axis as the flutes extend in a longitudinal direction from the second end toward the first end, at least a portion of each flute configured to provide an interference fit with the inner surface of the bore; and an outer passageway extending between the plurality of recesses of the aspirator and the inner surface of the bore, wherein the first end of the body includes an end wall sealingly engaging the inner surface of the bore for sealing the outer passageway from the first outlet.

9. The shower fitting of claim 8, wherein the outer passageway includes a first end sealed from the first outlet, a second end in open communication with the second outlet such that a negative pressure is exerted on the inner passageway by fluid flow through the outer passageway to the second outlet.

10. The shower fitting of claim 9, wherein the outer passageway includes a first cross-sectional flow area proximate the first end and a second cross-sectional flow area proximate the second end, the first cross-sectional flow area being greater than the second cross-sectional flow area.

11. The shower fitting of claim 8, further comprising a connecting port in fluid communication with the inlet and the bore, the connecting port extending radially relative to the bore and positioned adjacent the first end.

12. The shower fitting of claim 8, wherein the recesses of the flutes provide at least 0.080 inch clearance with the inner surface of the bore to permit passage of debris.

13. An aspirator for being positioned in a shower fitting having a vertical bore with a lower outlet and an upper outlet, the aspirator comprising:

a lower end;

an upper end spaced above the lower end and sealingly engaging an inner surface of the vertical bore between the lower outlet and the upper outlet;

a sidewall defining an inner passageway extending between the lower end and the upper end; and a plurality of longitudinally extending flutes supported by the sidewall and extending from the lower end toward the upper end, the flutes including a plurality of concave recesses within the vertical bore of the shower fitting, and a plurality of lands separating the plurality of recesses, the recesses in open communication with the lower outlet, wherein the flutes taper inwardly as the flutes extend from the lower end toward the upper end.

14. The aspirator of claim 13, wherein at least a portion of each flute is configured to provide an interference fit with the inner surface of the vertical bore.

15. The aspirator of claim 13, wherein an outer passageway is defined by the plurality of recesses intermediate the sidewall and the inner surface of the vertical bore, the outer passageway including an upper end sealed from the upper outlet, a lower end in open communication with the lower outlet such that a negative pressure is exerted on the inner passageway by fluid flow through the outer passageway to the lower outlet.

16. The aspirator of claim 15, wherein the outer passageway includes a first cross-sectional flow area proximate the upper end and a second cross-sectional flow area proximate the lower end, the first cross-sectional flow area being greater than the second cross-sectional flow area.

* * * * *